US006050461A

United States Patent [19]

Batts et al.

[11] Patent Number: 6,050,461

[45] **Date of Patent: *Apr. 18, 2000**

[54] HIGH RACK DENSITY SHIP ON HANGER WITH ANTI-DISLODGEMENT MEANS

[75] Inventors: John Batts, Grand Rapids; Donald F. Morgan, Zeeland; Russell O. Blanchard, Grand Rapids; Steven J. Brammer, Holland; Robert A. Bredeweg, Zeeland; Michael G. Kamps, Jenison; John D. Sykes, Grand Rapids, all of Mich.

[73] Assignee: Batts, Inc., Zeeland, Mich.

[ * ] Notice: This patent is subject to a terminal disclaimer.

[21] Appl. No.: 09/152,419

[22] Filed: Sep. 14, 1998

[51] Int. Cl.[7] ..... A47G 25/48

[52] U.S. Cl. ..... 223/96; 223/85

[58] Field of Search ..... 223/96, 95, 93, 223/91, 90

[56] References Cited

U.S. PATENT DOCUMENTS

| | | | |
|---|---|---|---|
| D. 146,998 | 6/1947 | Townsend et al. | D80/8 |
| D. 186,716 | 7/1959 | Nalle, Jr. | D80/8 |
| D. 206,207 | 11/1966 | Stein | D80/8 |
| D. 243,138 | 1/1977 | Coon | D6/253 |
| 1,081,058 | 12/1913 | Owens . | |
| 1,162,613 | 11/1915 | Kalina | 223/96 |
| 1,795,622 | 3/1931 | Taylor et al. | 223/96 |
| 2,573,467 | 10/1951 | Macaluso | 223/96 |
| 2,802,610 | 8/1957 | DeLier | 223/96 |
| 2,883,095 | 4/1959 | Greenbaum | 223/96 |
| 2,939,588 | 6/1960 | Nalle, Jr. | 211/113 |
| 3,946,915 | 3/1976 | Crane | 223/96 |
| 4,009,807 | 3/1977 | Coon | 223/96 |
| 4,706,347 | 11/1987 | Lindsay | 24/517 |
| 4,802,265 | 2/1989 | Stevenson | 24/335 |
| 5,082,153 | 1/1992 | Duester et al. | 223/96 |
| 5,212,854 | 5/1993 | Hollis | 24/487 |
| 5,398,854 | 3/1995 | Blanchard | 223/96 |
| 5,400,932 | 3/1995 | Hollis | 223/96 |

FOREIGN PATENT DOCUMENTS

| | | | |
|---|---|---|---|
| 15254/92 | 1/1995 | Australia | A47G 25/48 |

*Primary Examiner*—Bibhu Mohanty
*Attorney, Agent, or Firm*—Baker & McKenzie

[57] ABSTRACT

A ship-on garment hanger having ramp means on the hanger body to prevent dislodgement of a garment from the hanger by outwardly directly dislodging forces and end shields on the outside edges of the clamps to prevent dislodgement of a garment from the hanger by inwardly directed dislodging forces, the hanger being nestable with similar hangers to maximize shipping space.

17 Claims, 7 Drawing Sheets

HIGH RACK DENSITY SHIP ON HANGER WITH ANTI-DISLODGEMENT MEANS

This invention pertains generally to garment hangers and more specifically to a garment hanger adapted to be employed as a shipping hanger for garment-on-hanger use, said garment hanger further having means for (1) precluding dislodgement of a garment from its hanger by dislodgement forces encountered during transportation and push/pull forces arising during normal manipulation of garments by customers in retail outlets and (2) nesting said hangers to any desired extent so that said hangers may be used in semi-automatic or automatic garment-to-hanger assembly operations.

BACKGROUND OF THE INVENTION

A worldwide mode of doing business in the garment industry has evolved in recent years due to economic factors. For example, garments may be very inexpensively manufactured in less developed countries such as Sri Lanka, the garment hanger factory may be located in Taiwan or Hong Kong, and the garments may be destined for sale in the U.S. Thus it is quite common today for garments to be made in one country, the hangers on which the garments are to be displayed made in another country, and the garment displayed for sale in yet a third country.

At the retail sales level, there is an increasing trend to employ fewer and fewer selling personnel; indeed, the trend has almost reached a self-service mode of selling, though a few sales personnel will always be required for providing style information and fitting. The result however is that the ratio of number of garments to each sales person is increasing. While this ratio does not, in itself, present problems at the retail sale level (due to some extent at least, to lowered expectations of sales clerk assistance by retail customers), the greater number of garments in a retail store department presents logistics problems. For example, at the end of a selling day it is the duty of the sales personnel to straighten up the racks so that a neat and tidy appearance is presented to the eyes of the customers as they enter the department on the next selling day. The greater the number of garments on the racks per each sales person, the greater will be the time required by each sales person to straighten the racks, a fact which is not appreciated by sales personnel at the end of their shift. Part of the straightening process involves pulling a garment, say a size 36 men's slacks, which has been inadvertently placed in the size 38 section of the rack and inserting it into the size 36 section. At the present time this task can be very time consuming and frustrating, especially when the rack space is limited as it always is for a period of time after a new season's inventory has been received. Specifically, the pulling out and pushing in motions of extracting a garment from one location on a rack and inserting the garment into another location on the rack can result in a garment on either the moved hanger or a racked hanger dropping its garment, or at least one side of the garment. This usually occurs when the clip of one hanger engages the clip of another hanger in a direction and with a force to cause one jaw of one of the interfering clips to open slightly, thereby releasing the gripping pressure on the garment and letting it drop under the impetus of its own weight. When such an event occurs the time to straighten a rack is increased, much to the annoyance of the sales personnel.

The problem of contact between two hangers with resultant spillage also occurs in the absence of a need to change the physical location of a garment along the axis of a suspending rack. Specifically, during the course of a selling day adjacent garments will be pulled off the racks, or tilted upwardly for viewing, by customers, following which little or no effort is made to make sure that the viewed garment is returned to a level position. Indeed, at the end of a selling day, some hangers will be level some will be tipped upwardly at their outer end (i.e.: the end closest to the customer), and some will be tipped upwardly at their inner end. The result is a very untidy appearance. To return the garments to a neat, organized condition sales clerks prefer to either simply press downwardly on the upturned hangers or, at most, wiggle adjacent off-tilted hangers back and forth slightly so as to enable the garments to come back to a neutral position in which they hang straight down. Unfortunately these simple hand motions can also result in dropped garments due, to a considerable extent, to unlocking forces being exerted on one jaw of the two jaws which form the clamp at the end of each hanger. A basic cause of this problem is the fact that in most hangers in use today the upper portion of the clip which extends upwardly above the jaw is exposed in the sense that it projects into space outside the boundaries, and particularly the width dimensions, of the hanger.

A further problem which is keenly felt by the clothing manufacturers, though only indirectly by the ultimate consumer, is the high cost of freight attendant to shipping hangers from a hanger manufacturing facility to a garment hanger manufacturing facility. A hanger by its very design does not lend itself to neat, compact packaging and hence many hangers are shipped loose or in only a roughly aligned formation. In either event each hanger occupies the maximum shipping space defined by its maximum dimensions, and hence the number of hangers which can be shipped per cubic foot of shipping space is finite. It would be a great advantage for both the hanger manufacturer and the garment manufacturer to be able to ship hangers in a compressed or nested condition so that each hanger would occupy less space than the space its maximum dimensions define.

An even greater difficulty from the garment manufacturer's point of view is the high cost of assembling a garment to a hanger on a one by one basis; i.e.: the grasping of a single hanger from a jumbled pile of hangers by an assembly operator at the garment manufacturing location, placing the individually selected hanger in an assembly jig, and the subsequent assembly of a garment to the now stationary hanger.

SUMMARY OF TIE INVENTION

This invention is a garment hanger which overcomes all of the above described problems in a single hanger. Specifically, the garment hanger of this invention is manufactured so that each hanger nests within a similar hanger and, in turn, provides a nest for a similar hanger. In addition the hanger is so constructed that it is usable in a semi-automatic or automatic garment to hanger assembly operation and it will, (a) during transportation following assembly to a garment, (b) in the retail sales outlet, and (c) at all other times, grip a garment in such a fashion that the gripping pressure is not released and a garment dropped no matter how many shakes and bumps the hanger is subjected to during transportation or how quickly and carelessly garments are pulled from a rack and reinserted by customers, or pressed downwardly from above by the hands of a sales clerk passing over a series of hangers to bring the series into level alignment.

It is a further aim of this invention to accomplish all of the foregoing in a hanger which has a very low profile; that is, a hanger in which the clip at each end of the generally horizontally oriented hanger body does not project above the upper surface of the hanger body.

BRIEF DESCRIPTION OF THE DRAWING

The invention is illustrated more or less diagrammatically in the accompanying drawing wherein.

DESCRIPTION OF THE INVENTION

Figures 1, 5, 7:
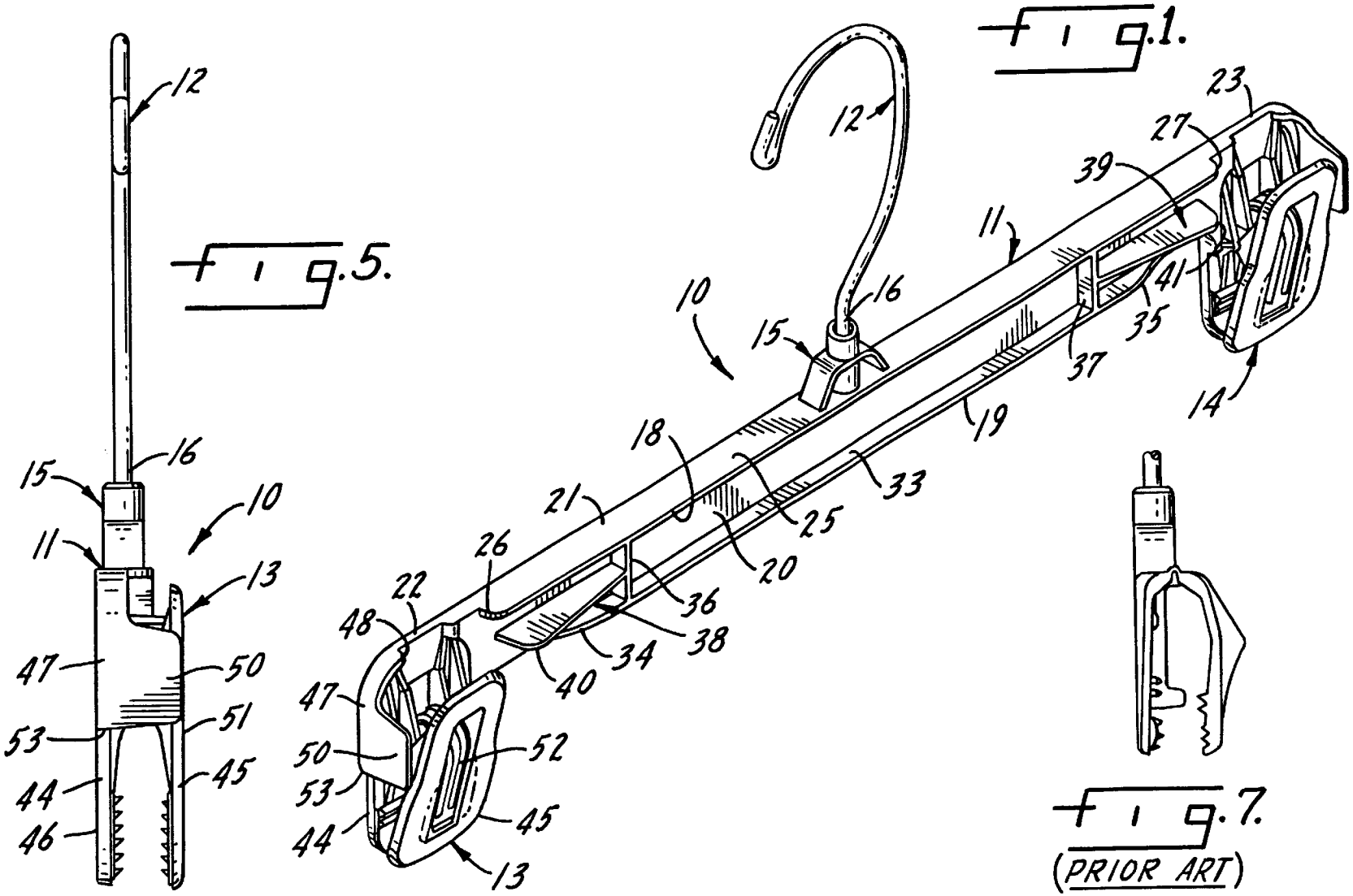
FIG. 7. (PRIOR ART)
FIG. 1 is a perspective view showing particularly the front side of the garment hanger of this invention in a normal, empty condition.
FIG. 5 is an end view with the garment omitted but showing the position of the jaws when holding a garment when viewed from the left side of FIG. 1.
FIG. 7 is a view similar to FIG. 5 of a conventional prior art construction.

Like reference numerals will be used to refer to like or similar parts from Figure to Figure in the following description of the invention.

The garment hanger of this invention is particularly well suited for assembly to a garment at a remote garment manufacturing location and thereafter retention of the garment on the hanger until the hanger is separated from the garment at the retail sales outlet by a retail sales clerk or by the purchaser at his home. In view of this highly desirable characteristic the hanger will sometimes hereinafter be referred to as a "ship-on" hanger.

Figures 2, 3:
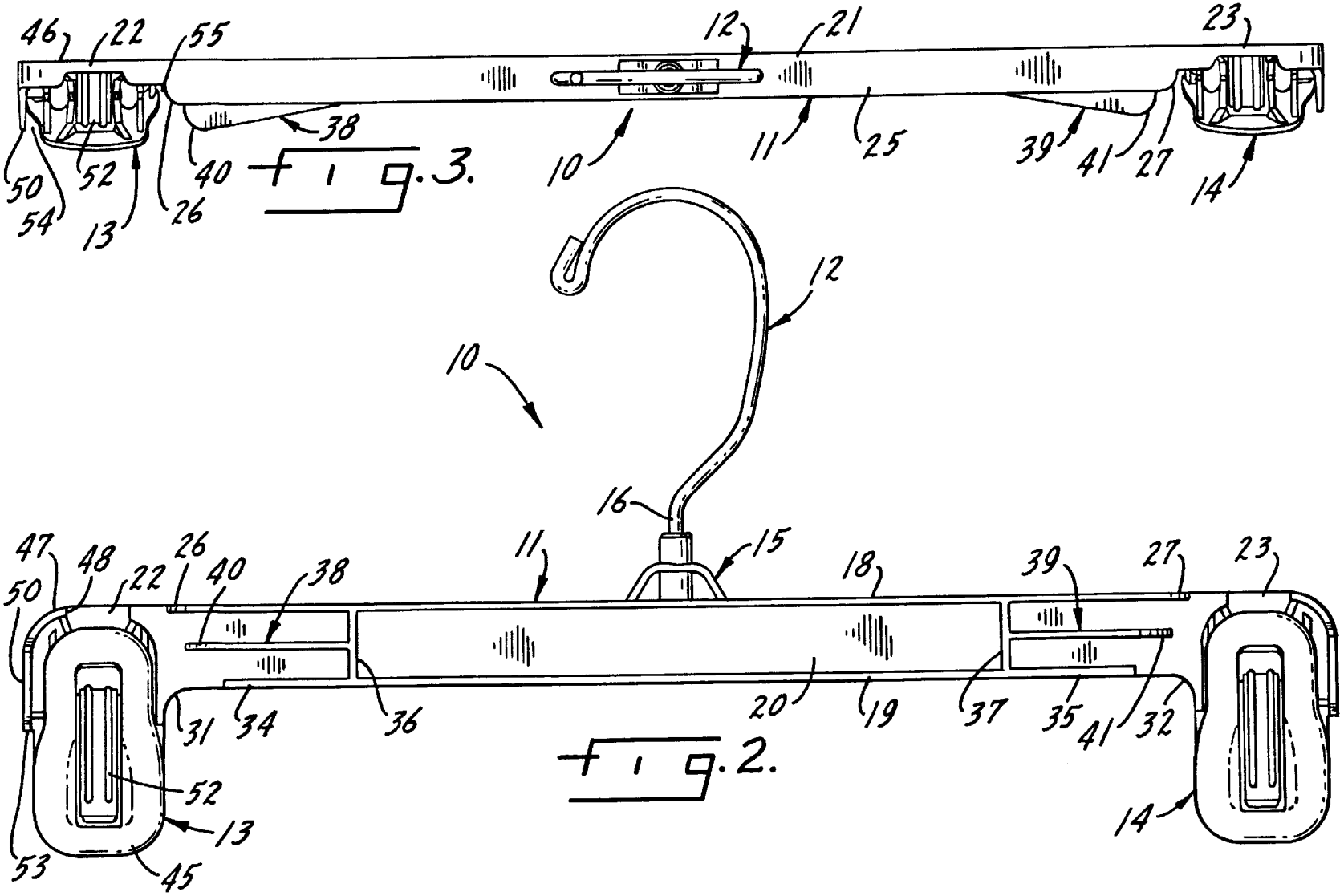
FIG. 2 is a front side elevation.
FIG. 3 is a top view.
Figures 4, 6:
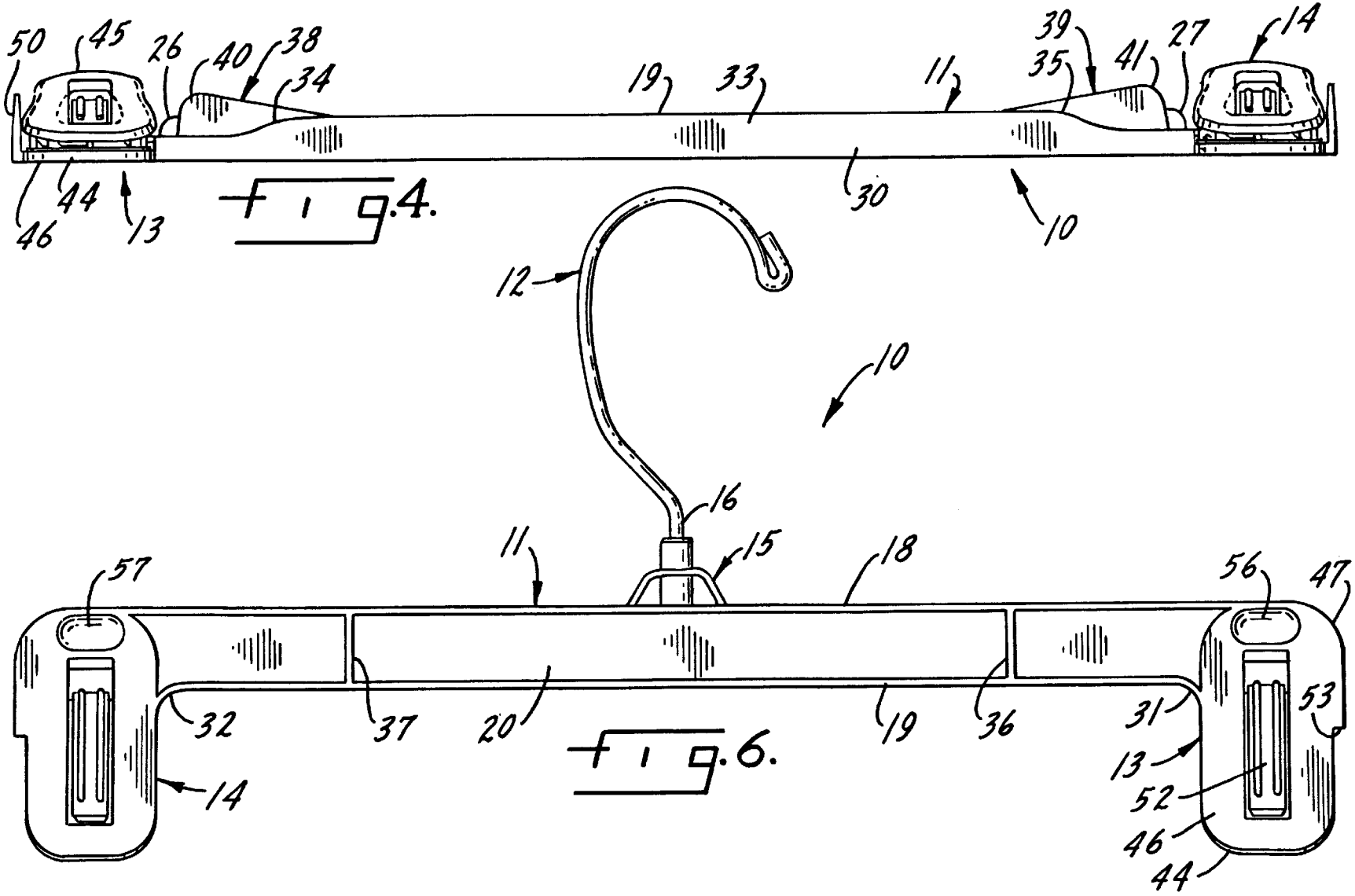
FIG. 4 is a bottom view of FIG. 2.
FIG. 6 is a rear elevation.

The ship-on hanger of this invention is indicated generally at 10 in FIGS. 1, 2 and 6. The hanger includes a horizontal body, indicated generally at 11, hook means, indicated generally at 12, and left and right clamp assemblies, indicated generally at 13 and 14 respectively. A hook boss is indicated generally at 15, the hook boss being, in this instance, formed integrally with the body 11 to provide a base or socket for receiving the tail section 16 of the hook means 12. It should be understood that the hook means 12 can be either rigidly held in the hook boss 15 or be rotatable with respect thereto. Both systems are conventional in the art though the advantages of the invention may be more markedly appreciated when the hook means is non-rigidly received in the hook boss.

Body 11 is formed in the shape of an I-beam consisting of an upper flange 18, a lower flange 19, and a web 20. The rear half 21 of upper flange 18 extends the length of the body and then, at its far left end portion, blends into and forms the upper surface 22 of left clamp assembly 13. By the same token the far right end portion blends into and forms the upper surface 23 of right clamp assembly 14. The front half 25 of the upper flange 18 terminates a short distance from the ends of rear half 21 as indicated by the rounded end edges 26 and 27.

The rear half 30 of lower flange 19 terminates at the clamp assemblies which are located at the ends of the body as will be noted from the, in this instance, rounded end portions 31 and 32 in FIG. 6. The front half 33 of lower flange 19 terminates well short of the clamp assemblies at the ends of the body as will be noted from the, in this instance, tapered end portions 34 and 35, which are spaced inwardly from their respective adjacent clamp assemblies.

A pair of internal vertical beams which, in this instance, extend from both sides of the web are indicated at 36 and 37, the inner ends of the beams forming an abutment surface from which left and right guide ramps, indicated generally at 38 and 39, respectively, extend in an outward direction, the guide ramps functioning as deflecting means as will appear hereinafter. Each deflecting ramp has an outward taper, as best seen in FIGS. 1, 3 and 4. From FIGS. 4 and 5 it will be noted that the horizontally outwardmost peripheral portions 40 and 41 of the outward taper is very closely aligned with the outside surface of the front half of its adjacent clamp assembly.

Since the clamp assemblies 13 and 14 are mirror images of one another only one need be described of which left clamp assembly 13 best illustrates the structure and advantages of this portion of the invention.

From FIGS. 1, 5 and 6 it will be seen that left clamp assembly 13 includes a rear half 44 and a front half 45. The rear surface 46 of the rear half 44 is, in this instance, flush with the edges of the upper and lower flanges 18 and 19. A curved flange portion 47 extends outwardly and downwardly from the rear half 44 as best seen in FIGS. 1 and 2. The right end 48 of curved flange portion 47 and left end edge 26 of the rear half of upper flange 21 are spaced apart to form an opening of a width sufficient to receive a U-shaped spring which is inserted from above to complete the assembly of the clamp as will be further amplified hereinafter.

An end shield is indicated at 50, the end shield 50 projecting outwardly from the downwardly extending portion of the curved flange portion 47, the end shield being therefore perpendicular to web 20. From FIG. 5 particularly it will be noted that the outwardmost extending edge of end shield 50 lies in a plane which is substantially flush with the outside surface 51 of the front half 45 of the clamp assembly in a garment hanging condition. The internal facing surfaces of the rear half 44 and front half 45 of the clamp assembly carry pivot structure which enables the two halves to pivot with respect to one another, in a conventional manner, under the resistance to separation provided by inverted U-shaped clamp spring 52.

The nesting function of the hanger is best appreciated from FIGS. 2, 3 and 4. Referring first to FIGS. 3 and 4 it will be noted that the left side of the rear half 44 of the clamp assembly has been cut away, as indicated at 53, a distance slightly greater than the thickness of the end shield 50. From FIGS. 2, 4 and 6 it will be noted that the width of the front and rear clamp halves do not extend beyond the inner edge of end shield 50; indeed, a slight clearance is indicated at 54. Further, a similar clearance 55 is shown on the inner side of the clamp assembly between the clamp assembly and the right edge 26 of the front half of the upper flange. Thus, since the distance between right edge 26 and the wide surface of the end shield 50 is greater than the maximum width of the clamp halves in an assembled condition, the lower end of a clamp assembly on an upper hanger may project downwardly into the open maw formed at the upper end of the clamp assembly on a lower hanger. By partially nesting the clamp assemblies at each end into adjacent clamp assemblies a considerable amount of shipping space can be saved when the hangers are shipped in bulk from a hanger manufacturing source to a garment manufacturing location.

Thumb locators, indicated at 56 and 57 on the body of the hanger assist the user in smooth and efficient manipulation of the hanger.

The guide ramps 38 and 39, and the end shields 50, provide great advantages to the retail store operator.

The ramps 38 and 39 aid the user in getting a hung garment on and off a display rack. Specifically, as a hung garment is pulled off a rack for example, the hanger of the pulled garment will strike the inclined surfaces of the guide ramp and deflect the pulled hung garment and its hanger outwardly away from contact with the outer half of a clamp assembly of the adjacent hung garment on the rack. In other words, the edges of the clamp assemblies to are not exposed to contact with a hung garment sliding in and out of the rack, and hence the opportunity for the clamp of a stationary hung garment being snagged and forced into an open position is eliminated.

The end shields 50 are particularly effective when hung garments are placed back onto a rack. Customers who have extracted a hung garment from a rack for observation are often quite careless in returning the garment which has just been observed back onto the rack. At the present time retail sales personnel are faced with the frequent task of picking up garments which have been completely or partially knocked off their hanger by careless and hurried handling by potential buyers. Since end shields 50 cover the outermost edges of the front halves of their associated clamp assemblies, there is no opportunity to snag a clamp on a racked garment and cause it to open and drop its garment.

It should also be noted that the illustrated and described construction provides maximum rack density; the greater the number of garments which can be displayed per lineal foot of rack the greater will be the sales of garments. By ensuring that (a) the edge of the end shields 50, (b) the outward most projecting portions of the guide ramps 38 and 39, and (c) the outside surface of the outer half of the clamp assembly, lie in the same plane when the hanger supports a garment, only the absolute minimum of rack length is required to display a garment. Indeed, in trials to date, a rack density of 12% greater than hangers which do not have ramps and shields has been achieved. This feature is illustrated best in FIG. 7 from which a comparison of the thickness of the clamp assembly of this invention can be compared to the thickness of a similar prior art clamp assembly. It will be noted that, in the prior art construction of FIG. 7, the requisite strength can only be obtained by the use of external reinforcing rib 56, the provision of which causes the clamp assembly, in side view, to be quite bulky. However by reason of the placement of the reinforcing ribs 57 and 58 in opposing positions with respect to one another as a result of the need to provide the flat outside surface 51 and on the inside surfaces of the clamp halves, up to approximately 20% thinner construction results.

It should also be noted that the greater than usual drop of the clamp assemblies from the hanger body enables a spring clip of a much longer vertical dimension to be used than was heretofore customary. With the illustrated construction the spring is able to reach down all the way to the tooth clamping areas of the inner portions of the jaws, and hence maximum spring derived clamping force is obtained. As a result creep of the clip during shipping of garments on hangers is eliminated and no garments are to be found lying in a crumpled heap at the bottom of the shipping container when it is opened at its destination.

And finally, a further advantage of the illustrated I-beam construction of the hanger body is that maximum strength can be obtained from a given quantity of material because of the high modulus of elasticity of the I-beam construction. In practical applications the thickness of the web and the flanges of the I-beam can be considerably thinner than has been the practice heretofore.

Figure 8A:
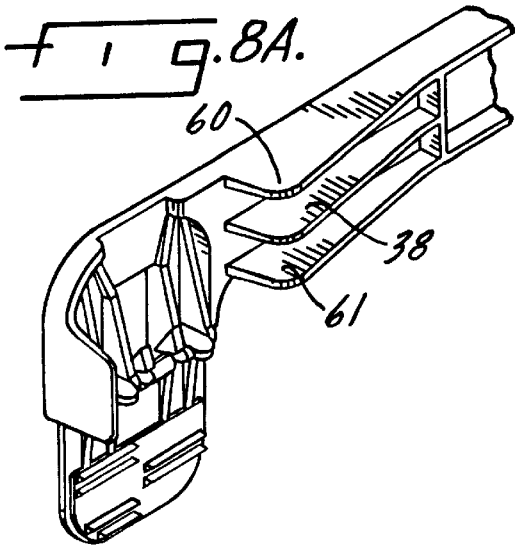
FIGS. 8A through 8F are partial perspective views with parts omitted for clarity of alternate embodiments of the number and location of guide ramps.
Figure 8B:
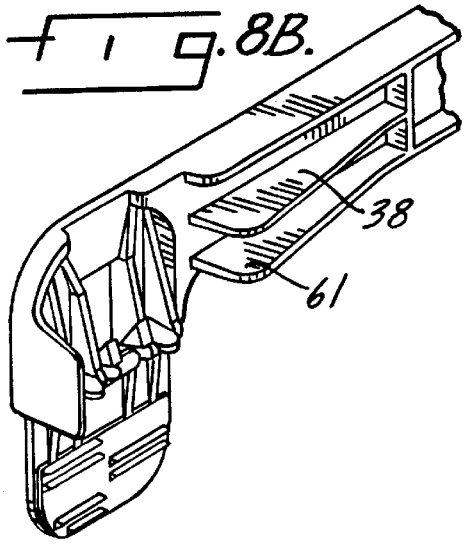
Figure 8C:
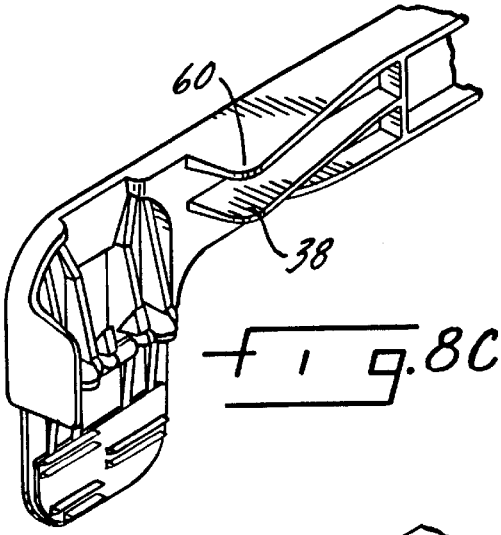
Figure 8D:
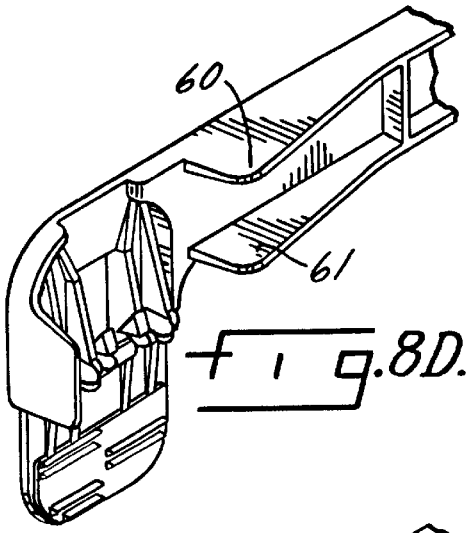
Figure 8E:
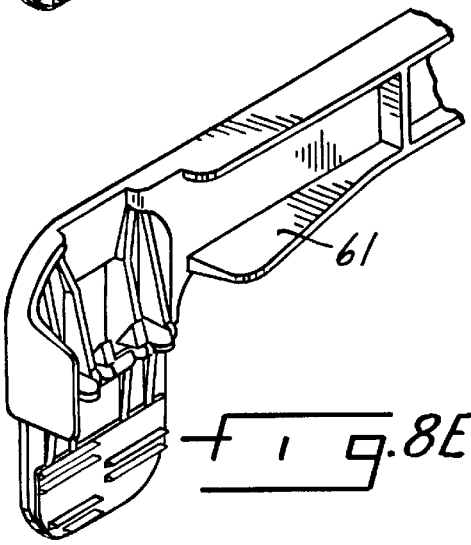
Figure 8F:
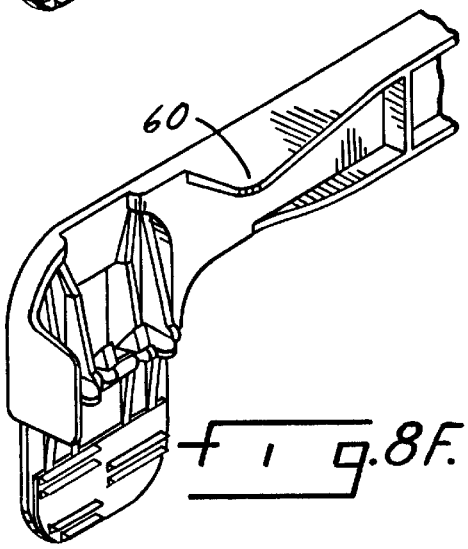

Alternate embodiments of the number and location of the guide ramps are illustrated in FIGS. 8A through 8F. In FIG. 8A a top ramp 60 and a bottom ramp 61 have been shown above and below center ramp 38; in FIG. 8B only center ramp 38 and bottom ramp 61 has been shown; in FIG. 8C only center ramp 38 and top ramp 60 have been shown; in FIG. 8D only top and bottom ramps have been shown; in FIG. 8E only bottom ramp 61 has been shown; and in FIG. 8F only top ramp 60 has been shown.

The highly advantageous nesting feature of the invention is illustrated in further detail in FIGS. 9–14 inclusive.

Figure 9:
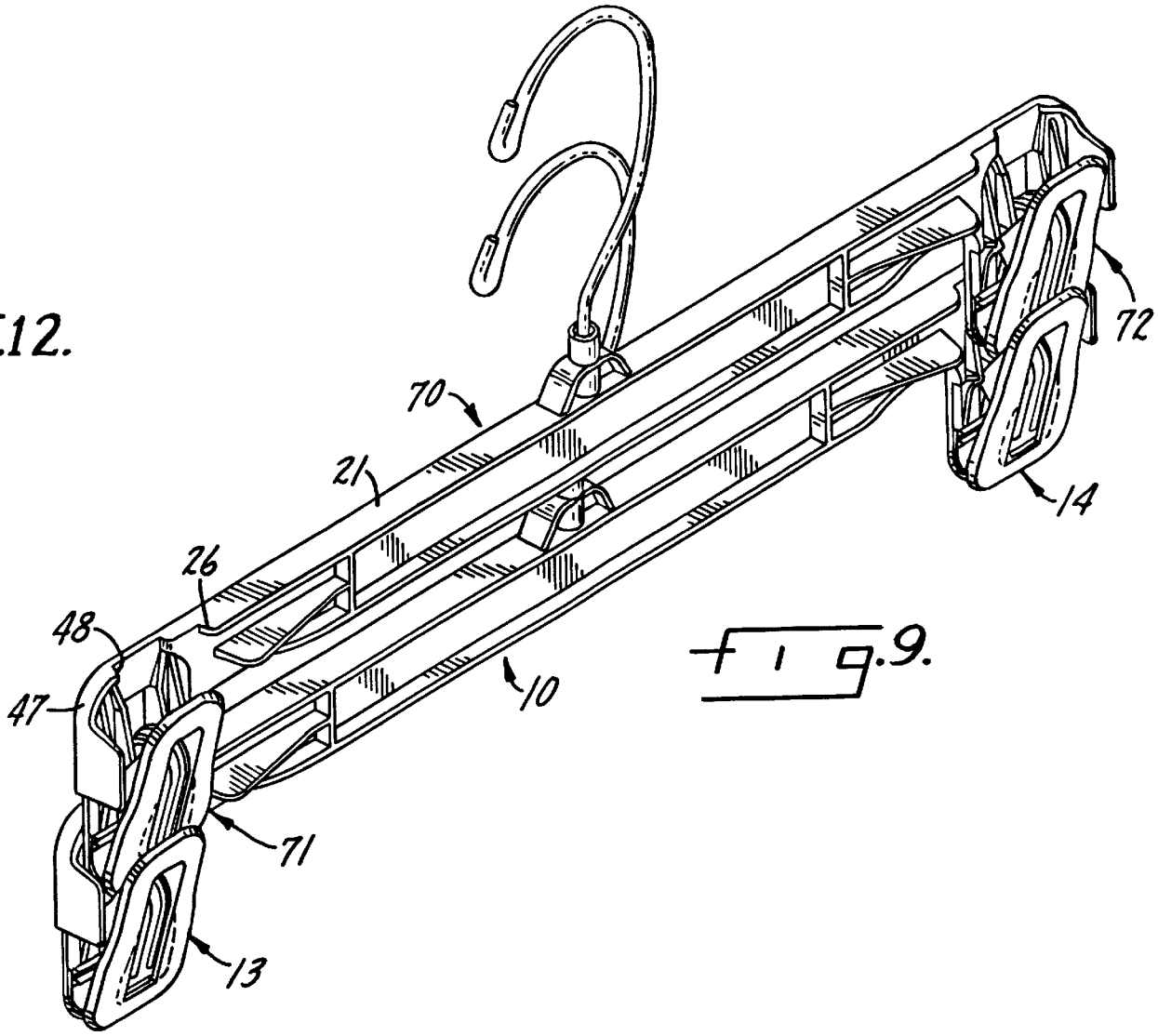
FIG. 9 is a perspective view of a plurality of the hangers of this invention in a nested condition preparatory to a semi-automatic or automatic garment-to-hanger assembly operation.

FIG. 9 shows hanger 10 receiving, in a nesting relationship, an additional hanger indicated generally at 70.

Figures 10, 11:
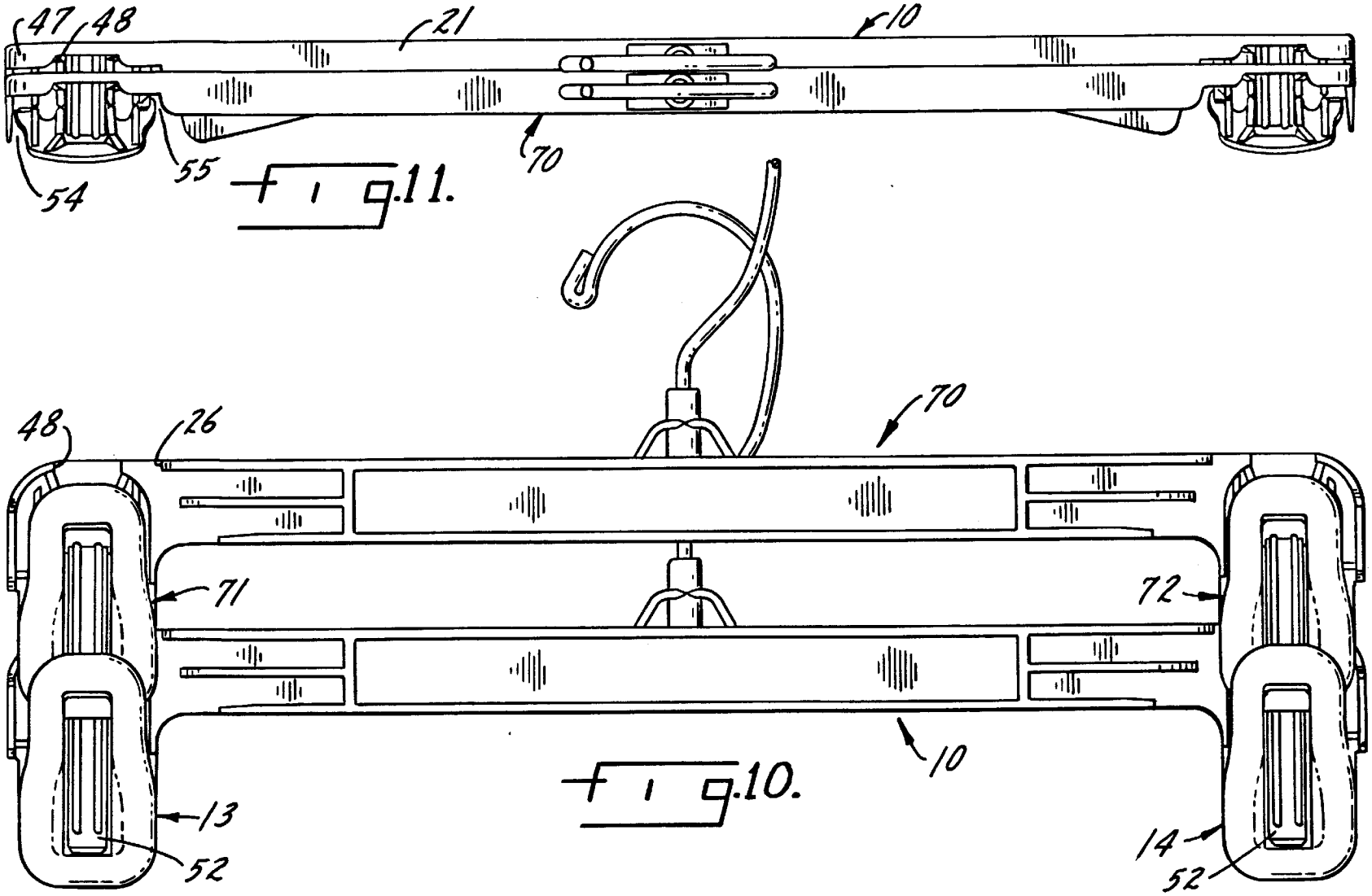
FIG. 10 is a front side elevation of the nested hangers of FIG. 9.
FIG. 11 is a top view of FIG. 10.

FIG. 10 illustrates the significant depth to which the clamp assemblies 71 and 72 of hanger 70 are lodged in their respective, preceding clamp assemblies 13 and 14 respectively. It will be understood that the tightness of fit of the clamp assemblies 71 and 72 into their mating assemblies 13 and 14 can be controlled by design of both the location of the upper surface of the springs 52 in clamp assemblies 13 and 14 and the width between the end 48 of curved flange portion 47 and the left end edge 26 of the rear half of the upper flange 21. In this instance a very slight width clearance has been provided to ensure that the hangers will not bind in an assembly machine due to a slight misalignment of a nested group of hangers in the machine.

Figure 12:
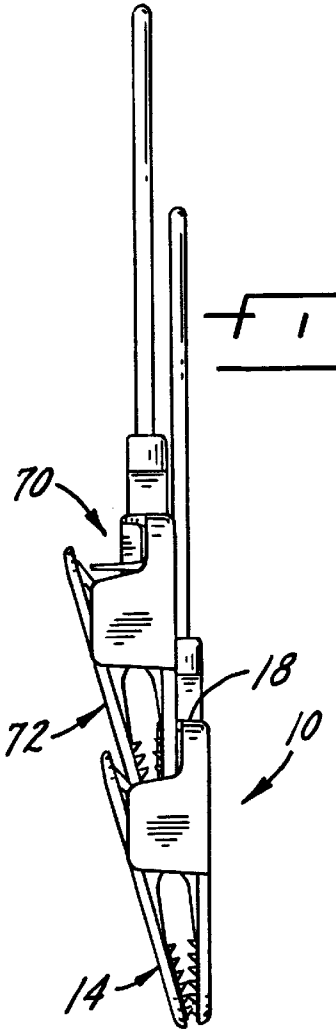
FIG. 12 is an end view of FIG. 10.

FIGS. 11 and 12 show the clearances referred to above, and the fact that, of necessity, the hangers are offset in a Z direction due to the width of the upper flange 18.

Figure 13:
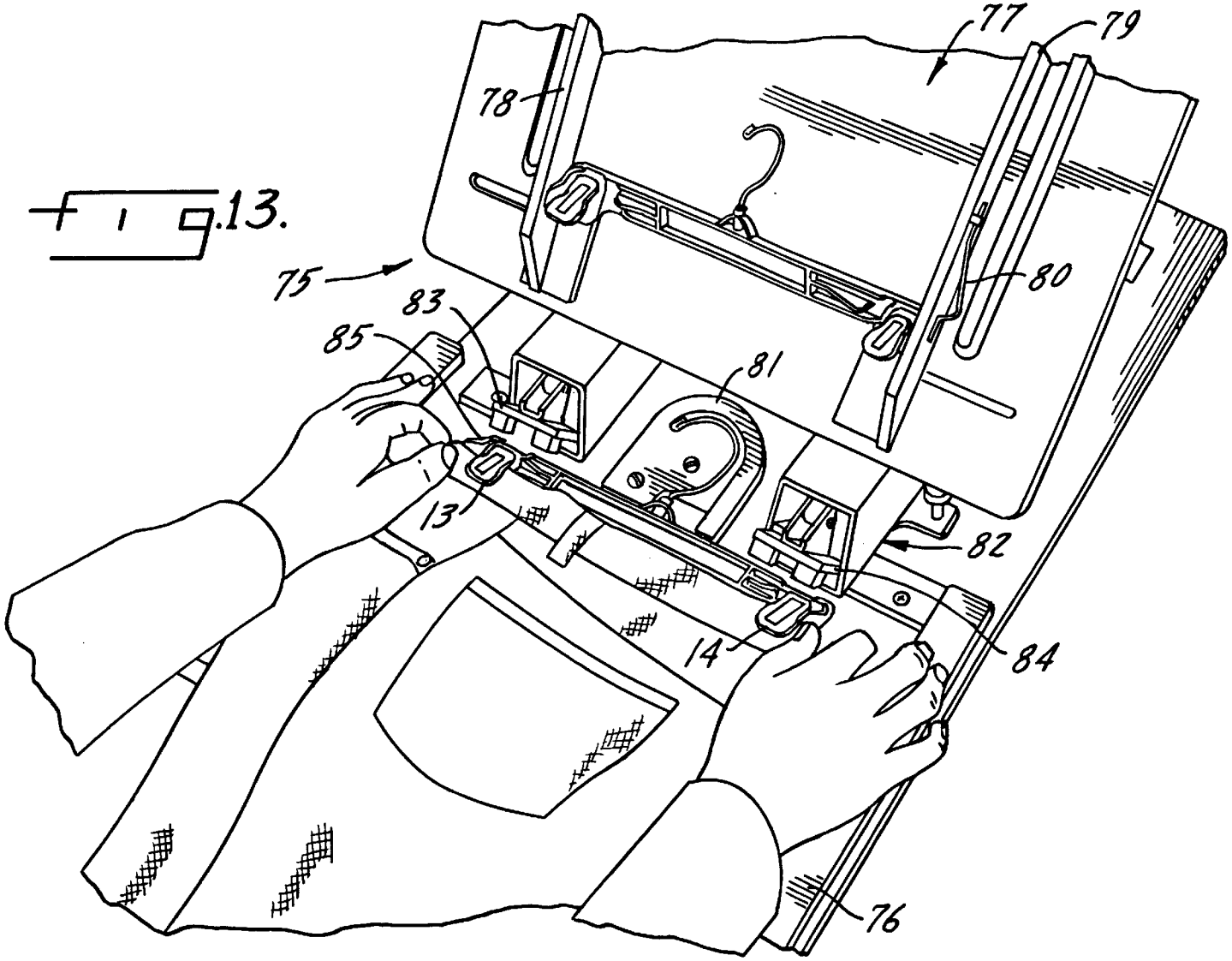
FIG. 13 is a view of an automated garment-to-hanger assembly operation.

In FIG. 13 a garment-to-hanger assembly machine, here a semi-automatic machine, is indicated generally at 75. The machine includes a platen 76 and a hopper chute, indicated generally at 77, which is spaced upwardly and inclined upwardly and rearwardly from the platen 76. It will be understood that any suitable support structure for maintaining the platen and chute in the illustrated position may be provided. The hopper chute includes adjustable guide rails 78 and 79 and a hanger retention spring 80 which operates to allow one hanger at a time to be released from the bottom of the stacked hangers.

An adjustable hook guide, which is removable to accommodate hangers of differing sizes, is indicated at 81. An adjustable clamping head is indicated generally at 82, the clamping head having a pair of clamping jaws 83 and 84.

In the illustrated condition a hanger 85 has dropped from the bottom of the nested group of hangers in hopper chute 77 into the hook guide 81 so as to be in position to receive a garment. The operator then places a garment from a stack of nearby garments into the jaws 13 and 14 of hanger 85 and is about to activate the machine, as by pressing on a knee operated switch which is part of a pneumatic-electric circuit.

It will be understood that at this moment in time, the springs 52 are not in clamping engagement with the front and rear halves of the clamp assemblies 13 and 14. Upon activation of the machine by the operator the rear half 44 and front half 45 of each clamp assembly are brought into gripping engagement with the upper end of the garment and spring clamped together.

This operation can be performed as quickly as an operator can pick up and place a garment on the platen 76 since the dropping of a hanger into the hook guide 81 and the clamping action of the clamp assemblies into gripping engagement with the garment may require only a second or less.

Although a specific example, and modifications thereof, have been illustrated and described, it will at once be apparent to those skilled in the art that modifications to the basic inventive concept may be made within the spirit and scope of the invention. Hence the scope of the invention should only be limited only by the scope of the hereafter appended claims when interpreted in light of the relevant prior art, and not by the foregoing exemplary description.

What is claimed is:

1. For use in an automated garment-to-hanger assembly operation, in a nestable high rack density ship-on garment hanger having a hanger body, clamp means on the hanger body for holding a garment, and suspending means for suspending the hanger body, clamp means and a garment from a support location, the improvement comprising means for preventing unintended opening of the clamp means during shipment and display of a garment held on said hanger, said means for preventing unintended opening of the clamp means including first means on the hanger body for protecting the inside edges of each of the clamp means from contact with dislodgement forces, and second means on each of the camp means for protecting the outside edges of each of the clamp means from contact with dislodgement forces, said first means is ramp deflector means which extends gradually outwardly from the hanger body to a distance substantially equal to the distance that the clamp means project outwardly from the hanger body when said clamp means holds a garment, and nesting means for receiving a duplicate hanger in nesting relationship, whereby a plurality of said hangers may be shipped in nested condition and presented in nested condition in a garment-to-hanger assembly operation.

2. The nestable high rack density ship-on garment hanger of claim 1 further characterized in that the clamp means includes two clamp halves, the outside face of one of said clamp halves being substantially co-extensive with the adjacent outside face of the hanger body, the outside face of the other of said clamp halves projecting outwardly beyond the adjacent outside face of the hanger body, said ramp deflector means extending outwardly from the hanger body adjacent to the other of said clamp halves.

3. The nestable high rack density ship-on garment hanger of claim 1 further characterized in that said second means is a shielding member which projects outwardly from the outer edge of one of the clamp halves a distance sufficient to shield the outermost edges of its associated clamp halves from contact with dislodgement forces.

4. A nestable high rack density ship-on garment hanger for use in an automated garment-to-hanger assembly operation, said hanger comprising a hanger body, clamp means on the hanger body for holding a garment, and suspending means for suspending the hanger body, clamp means and a garment from a support location, means for preventing unintended opening of the clamp means during shipment and display of a garment held on said hanger, and nesting means for receiving a duplicate hanger in nesting relationship whereby a plurality of said hangers may be shipped in nested condition and presented in nested condition in a garment-to-hanger assembly operation, said means for preventing unintended opening of the clamp means including first means on the hanger body for protecting the inside edges of each of the clamp means from contact with dislodgement forces, and second means on each of the clamp means for protecting the outside edges of each of the clamp means from contact with dislodgement forces, said first means being ramp deflector means which extends gradually outwardly from the hanger body a distance substantially equal to the distance that the clamp means project outwardly from the hanger body when said clamp means holds a garment, and said second means being a shielding member which projects outwardly from the outer edge of one of the clamp halves a distance sufficient to shield the outermost edges of its associated clamp from contact with dislodgement forces.

5. The nestable high rack density ship-on garment hanger of claim 4 further characterized in that the clamp means includes two clamp halves, the outside face of one of said clamp halves being substantially co-extensive with the adjacent outside face of the hanger body, the outside face of the other of said clamp halves projecting outwardly beyond the adjacent outside face of the hanger body, said ramp deflector means extending outwardly from the hanger body adjacent to the other of said clamp halves.

6. The nestable high rack density ship-on garment hanger of claim 1 further characterized in that the clamp means do not project above the hanger body.

7. The nestable high rack density ship-on garment hanger of claim 6 further characterized in that said means for preventing unintended opening of the clamp means includes first means on the hanger body for protecting the inside edges of each of the clamp means from contact with dislodgement forces, and second means on each of the clamp means for protecting the outside edges of each of the clamp means from contact with dislodgement forces.

8. In a high rack density ship-on garment hanger having a hanger body, clamp means on the hanger body for holding a garment, and suspending means for suspending the hanger body, clamp means and a garment from a support location, the improvement comprising means for preventing unintended opening of the clamp means during shipment and display of a garment held on said hanger, said means for preventing unintended opening of the clamp means including first means on the hanger body for protecting the inside edges of each of the clamp means from contact with dislodgement forces, and second means on each of the clamp means for protecting the outside edges of each of the clamp means from contact with dislodgement forces, said first means being ramp deflector means which extends gradually outwardly from the hanger body to a distance substantially equal to the distance that the clamp means project outwardly from the hanger body when said clamp means holds a garment.

9. The high rack density ship-on garment hanger of claim 8 further characterized in that the clamp means includes two clamp halves, the outside face of one of said clamp halves being substantially co-extensive with the adjacent outside face of the hanger body, the outside face of the other of said clamp halves projecting outwardly beyond the adjacent outside face of the hanger body, said ramp deflector means extending outwardly from the hanger body adjacent to the other of said clamp halves.

10. The high rack density ship-on garment hanger of claim 8 further characterized in that said second means is a shielding member which projects outwardly from the outer edge of one of the clamp halves a distance sufficient to shield the outermost edges of its associated clamp from contact with dislodgement forces.

11. The high rack density ship-on garment hanger of claim 10 further characterized in that the clamp means includes two clamp halves, the outside face of one of said clamp halves being substantially co-extensive with the adjacent outside face of the hanger body, the outside face of the other of said clamp halves projecting outwardly beyond the adjacent outside face of the hanger body, said ramp deflector means extending outwardly from the hanger body adjacent to the other of said clamp halves.

12. The high rack density ship-on garment hanger of claim 14 further characterized in that the clamp means do not project above the hanger body.

13. The high rack density ship-on garment hanger of claim 12 further characterized in that said means for preventing unintended opening of the clamp means includes first means on the hanger body for protecting the inside edges of each of the clamp means from contact with dislodgement forces, and second means on each of the clamp means for protecting the outside edges of each of the clamp means from contact with dislodgement forces.

14. The high rack density ship-on garment hanger of claim 13 further characterized in that said first means is ramp deflector means which extends gradually outwardly from the hanger body to a distance substantially equal to the distance that the clamp means project outwardly from the hanger body when said clamp means holds a garment, said second means is a shielding member which projects outwardly from the outer edge of one of the clamp halves a distance sufficient to shield the outermost edges of its associated clamp from contact with dislodgement forces.

15. A nestable high rack density ship-on garment hanger for use in an automated garment-to-hanger assembly operation, said hanger comprising a hanger body, a clamp assembly at one end of said hanger body, and a hook extending upwardly from the hanger body, said clamp assembly including a front portion and a rear portion, said rear portion being an extension of said hanger body and said front portion being pivotably held against said rear portion by a spring, said spring tending to push lower parts of said front and rear portions toward each other and upper parts of said front and rear portions away from each other, said upper parts of said front and rear portions defining a nest, said nest being shaped to receive lower parts of a duplicate hanger in nesting relationship, whereby a plurality of said hangers may be shipped in nested condition and presented in nested condition in a garment-to-hanger assembly operation, said hanger body having a ramp deflector extending gradually outwardly from the hanger body a distance substantially equal to the distance that said front portion of said clamp assembly projects outwardly from the hanger body when said clamp assembly holds a garment, and a shield projecting outwardly from an outer edge of said rear portion of said clamp assembly, said shield projecting a distance sufficient to limit transfer of dislodgement forces to outer edges of said front portion of said clamp assembly when said clamp assembly holds a garment.

16. The nestable high rack density ship-on hanger of claim 1 further characterized in that said lower parts of said front and rear portions of said clamp assembly have widths smaller than the width of said upper parts of said front and rear portions.

17. The nestable high rack density ship-on garment hanger of claim 1 further characterized in that the clamp assembly does not project above the hanger body.

* * * * *